United States Patent [19]

Gibson

[11] 4,101,077

[45] Jul. 13, 1978

[54] CAULKING SPOUT

[75] Inventor: Robert R. Gibson, Atlanta, Ga.

[73] Assignee: William J. Van Horne, Atlanta, Ga.

[21] Appl. No.: 784,080

[22] Filed: Apr. 4, 1977

[51] Int. Cl.[2] ..... B05B 1/06

[52] U.S. Cl. ..... 239/598

[58] Field of Search ..... 222/47, 41, 23, 570, 222/567, 553, 522, 568, 569; 239/598; 401/194, 265, 9, 266

[56] References Cited

U.S. PATENT DOCUMENTS

| | | | |
|---|---|---|---|
| 264,841 | 9/1882 | Poland | 222/568 |
| 3,058,632 | 10/1962 | Stremmel | 222/567 |
| 3,279,971 | 10/1966 | Gardener | 222/567 |
| 3,559,234 | 2/1971 | Swayze | 425/182 |

*Primary Examiner*—Joseph F. Peters, Jr.

*Assistant Examiner*—Norman L. Stack, Jr.

*Attorney, Agent, or Firm*—Robert B. Kennedy

[57] ABSTRACT

A caulking spout through which caulk may be dispensed from a dispenser into a corner joint at various angles of attack without an accompanying substantial change in the shape of the bead of caulk being dispensed. The spout comprises a body having a neck elongated along a body axis merging with a rounded tip traversing the axis and an outlet orifice formed in the rounded tip to one side of and off the body axis. An inlet orifice is formed in the end of the elongated neck distal the rounded tip. A channel communicates between the inlet and outlet orifices with a first channel portion extending from the inlet orifice along the body axis and merging with a second channel portion which diverges from the body axis and terminates at the outlet orifice.

10 Claims, 11 Drawing Figures

CAULKING SPOUT

BACKGROUND OF THE INVENTION

This invention relates to spouts of the type adapted to channel filler fluid material such as caulk into corner joints from dispensers.

Heretofore, various tools and implements have been devised for shaping ribbons or beads of caulk disposed within structural joints. These implements have generally been of one or two general types, namely that of trowels or rakes and that of spouts or nozzles. Exemplary of those implements of the trowel or rake type are those disclosed in U.S. Pat. Nos. 888,069, 2,847,700, 3,133,300, 3,155,997, 3,761,992 and 3,846,060. Though these trowel type implements may perform satisfactorily in shaping beads of caulk they normally require that the caulk bead has already been laid before the tools may be effectively utilized. Thus, in an attempt to form the bead as it is being dispensed from a caulk dispenser nozzle in a single operation, the spout-type implements have also heretofor been devised as disclosed in U.S. Pat. Nos. 796,246, 2,988,775, 3,087,654, 3,559,234, and 3,627,435. The present invention provides an improvement in the state of the art of this latter type of implement.

A common attribute of prior art caulking spouts and nozzles has been their ability to perform properly by dispensing a bead of preselected shape and size only when oriented at a preselected angle of attack or tilt between the spout and the joint to be caulked. Thus, previous caulking spouts have typically included one or more surfaces designed to be placed flush with the intersecting structural members of the joint to serve as guides. Where the spouts have not been so placed in sliding contact the shape of the bead changes by becoming fuller to one side or another thereby creating a need to move the spout again over the uneven area to smooth it to a uniform configuration. Where the angle of attack or tilt is changed a surface of the spout in sliding abutment with a joint wall will lift whereupon the spout will ride on either its leading or trailing edge. This creates instability and usually alters the shape of the caulk beads.

Thus, it is apparent that proper caulking operations with the prior art caulking spouts attached directly to caulk dispenser usually has required that the user maintain a preselected angle of attack throughout a caulking operation.

Typically, this is quite difficult to do in actual practice such as in caulking joints between ceilings and walls. In such cases the worker must hold the dispenser above his head and walk beneath the joint or move his arm in a series of short strokes. Not only is this difficult to do with accuracy but it is also fatiguing which leads to less accuracy and a resulting unevenness in the bead. Furthermore, where a three-way joint such as in a room corner is to be caulked, the structure of the prior spouts has frequently been such as to preclude a dispensing of an even bead directly into the corner.

Accordingly, it is a general object of the present invention to provide an improved caulking spout.

More specifically, it is an object of the present invention to provide a spout from which a uniform bead of caulk may be dispensed into a corner joint with the spout assuming various angles of attack.

Another object of the invention is to provide a caulking spout possessing the just described attribute by which the shape of the head may be altered through a simple spout twisting or rotation operation.

Another object of the invention is to provide a caulking spout of the type described which may be easily, firmly, and releasibly mounted to a caulk dispenser nozzle.

Another object of the invention is to provide a caulking spout of the type described of relatively simple and economic construction.

SUMMARY OF THE INVENTION

In a preferred form of the invention a caulking spout is provided through which caulk may be dispensed from a dispenser into a corner joint at various angles of attack without an accompanying substantial change in the shape of the bead of caulk being dispensed. The spout comprises a body having a neck elongated along a body axis merging with a rounded tip traversing the body axis, and an outlet orifice formed in the rounded tip to one side of and off the body axis. An inlet orifice is formed in the end of the elongated neck distal the rounded tip. A channel communicates between the inlet orifice and the outlet orifice with a first channel portion extending from the inlet orifice along the body axis and merging with a second channel portion which diverges from the body axis and terminates at the outlet orifice.

BRIEF DESCRIPTION OF THE DRAWING

FIG. 6 is another perspective view of the caulking spout illustrated in FIG. 1 shown dispensing a bead of caulk of one shape while

FIG. 8 is another perspective view of the caulking spout of FIG. 1 shown dispensing a bead of caulk at a relatively low angle of attack while

DESCRIPTION OF THE PREFERRED EMBODIMENT

Figure 1:
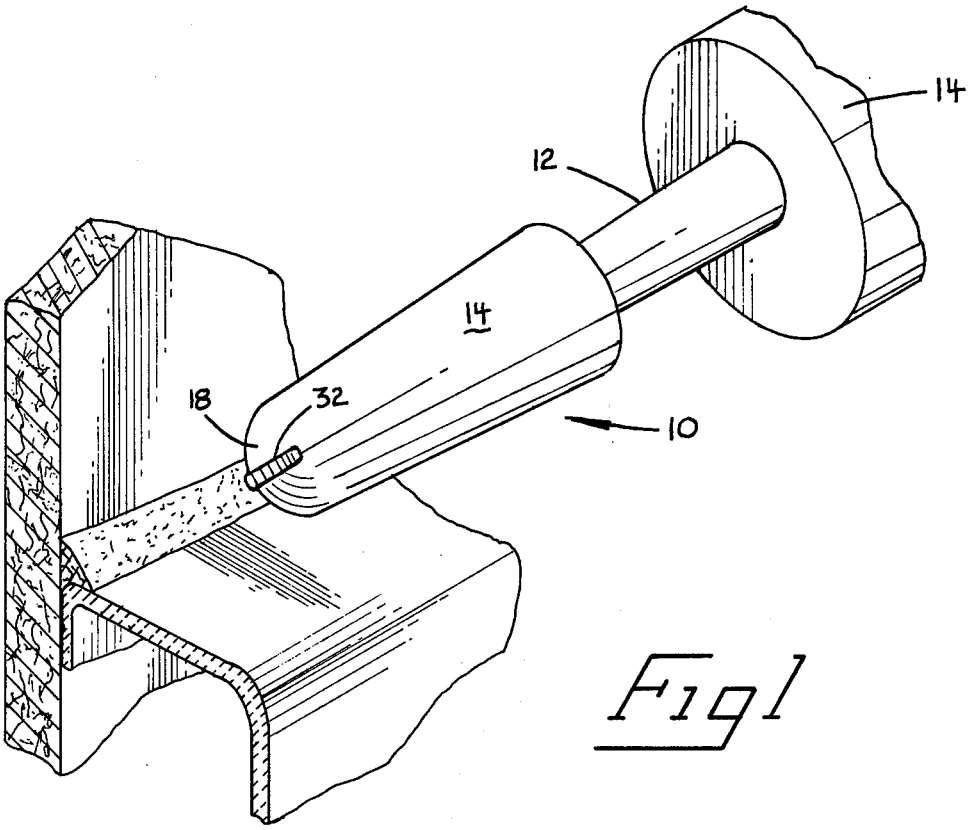
FIG. 1 is a perspective view of a caulking spout embodying principles of the invention in a preferred form shown mounted to a dispenser nozzle through which caulk is being dispensed into a corner joint.
Figure 2:
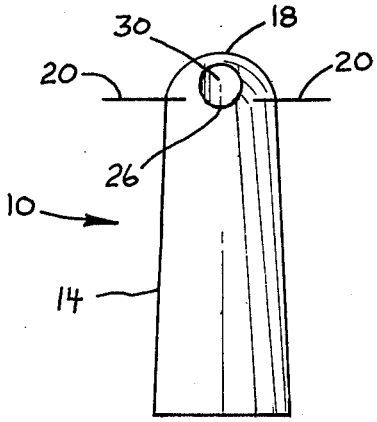
FIG. 2 is a side elevational view of the caulking spout shown in FIG. 1.
Figure 3:
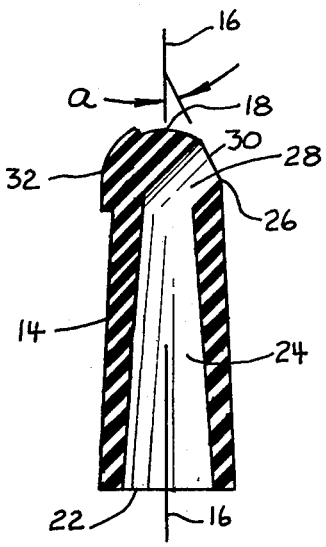
FIG. 3 is a side view, in transverse cross-section, of the caulking spout in FIG. 1.
Figure 4:
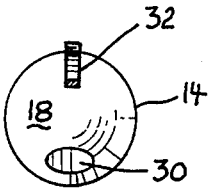
FIG. 4 is a plan view of the caulking spout shown in FIG. 1.
Figure 5:
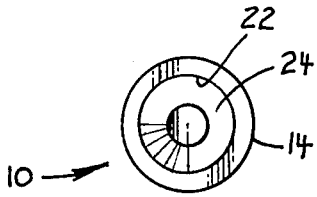
FIG. 5 is a bottom view of the caulking spout shown in FIG. 1.

Referring now in more detail to the drawing, there is shown a caulking spout 10 mounted to the end of a nozzle 12 of a tubular dispenser 14 in which a supply of caulk is housed. The spout comprises a plastic body having a neck 14 of generally cylindrical but slightly conically tapered structure elongated along a body axis 16. One end of the body is formed by a semi-spherically rounded tip 18 which uniterally merged with the body neck 14. The entire body is preferably composed of an injection molded plastic with the tip being of softer composition than the neck. For example, the tip may be formed of a soft urethane and the neck of a polypropylene or polycarbonate.

The end of the neck distal tip 18 is provided with an inlet orifice 22 from which a conically tapered channel 24 extends along the body axis 16. Adjacent the area in which the neck 14 merges with the rounded tip 18 channel 24 also merges with another channel 28 that diverges from body axis 16 and terminates at an outlet orifice 30. The outlet orifice is thus formed in the rounded spherical tip 18 off of and to one side of body axis 16. The orifice is annular and lies along a plane at a preferred angle a of between approximately 20° and 30° to axis 16 with an accuate segment 26 approximately tangent with the plane of merger 20 of neck and tip. A rib 32 projects uniterally from the rounded tip along the side thereof diametrically opposite that side of the tip in which the outlet orifice is formed.

Figure 6:
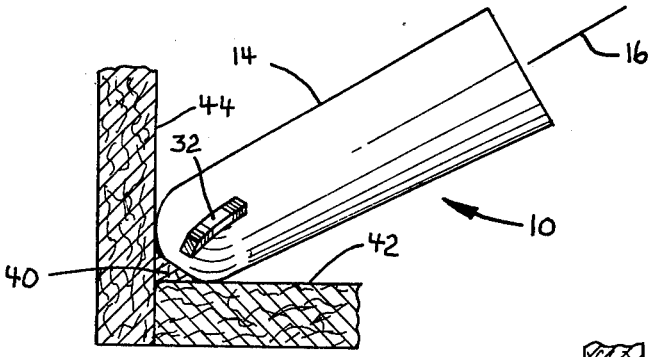
Figure 7:
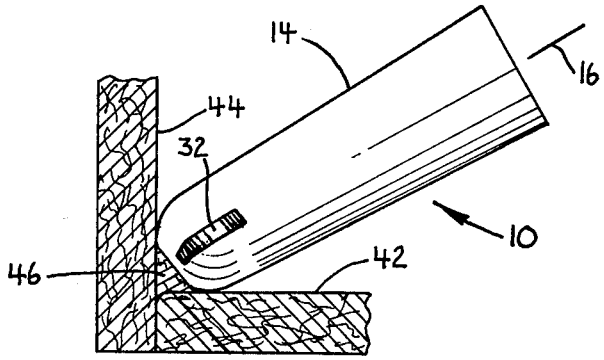
FIG. 7 illustrates the same caulking spout rotated from its position shown in FIG. 6 dispensing a bead of caulk of a shape differing from that shown in FIG. 6.
Figure 8:
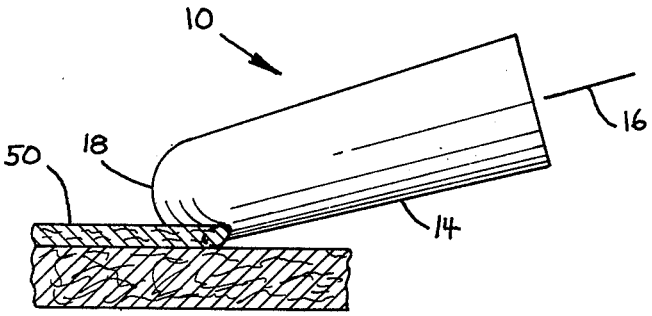

With reference next FIGS. 6–11, the unique manner in which the caulking spout functions may be visualized. First, the spout may be easily and securely mounted to the dispenser by inserting dispenser nozzle 12 into the spout channel 24. In performing this operation care should be taken in locating the index rib 32 with respect to any dispenser handle if such is provided to facilitate handling. Next, the rounded tip of the spout may be placed in a corner joint as shown in FIG. 6 with a two point sliding contact of spout to walls. Caulk is then pressed out of the dispenser and dispenser nozzle through the spout and out of spout outlet orifice 30 as the spout is pulled away from the viewer in FIG. 6. In this manner a bead of caulk 40 is formed between the two walls 42 and 44.

In FIG. 6 it will be seen that more of the caulk is applied to the surface of wall 42 than to wall 44. By merely rotating or twisting the spout about its body axis the orientation shown in FIG. 7 may be assumed whereupon a bead of caulk 46 is dispensed with more caulk being applied to the surface of wall 44 than to wall 42. In this manner the bead track may be varied slightly to cover random chips and cracks in the joint.

Figure 9:
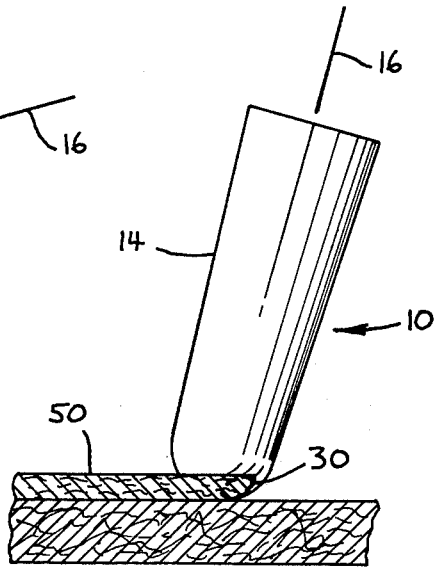
FIG. 9 shows the caulking spout dispensing a bead of caulk of the same size and configuration as that shown in FIG. 8 but at a relatively high angle of attack.

Whereas rotation of the spout about its body axis enables the user to control the configuration of the bead or ribbon of caulk being dispensed, a change in the angle of attack or tilt of the spout does not ordinarily have a substantial effect on the bead configuration. Thus, in FIG. 8 the angle of attack is quite shallow while emitting a bead of caulk 50 while in FIG. 9 the angle of attack of the spout is quite steep but with same bead of caulk 50 of same shape being emitted. The angle of attack thus may be changed from approximately 10° to approximately 80° with respect to the wall before a substantial change in the configuration of the bead is effected. This enables a worker to remain stationery and apply a continuous bead of caulk to an overhead or floor joint for a substantial distance before having to relocate himself to avoid a change in the bead configuration. Simultaneously, the capability shown in FIG. 6 and 9 is retained.

Figure 10:
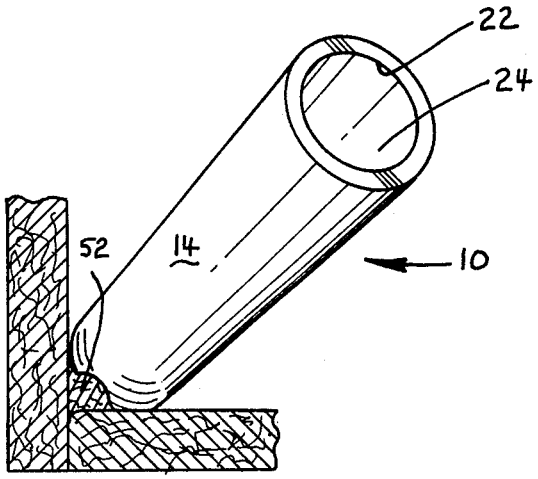
FIG. 10 is a perspective view of the caulking spout of FIG. 1 shown dispensing a bead of caulk towards a corner joint while in FIG. 11 the same caulking spout is shown dispensing a bead of caulk from the corner joint at along another joint extending normally therefrom.
Figure 11:
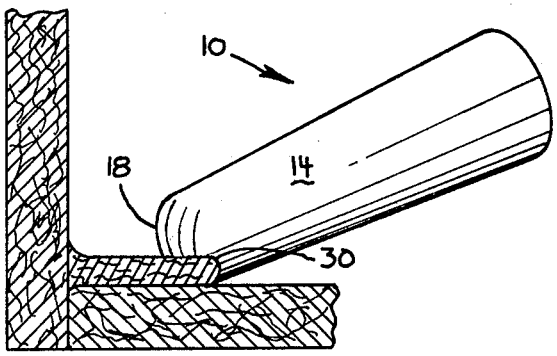

In FIGS. 10–11 the caulking spout 10 is shown caulking a three-way joint formed by three mutually normal, intersecting surfaces as in the corner of a room at a floor or ceiling. In FIG. 10 a ribbon of caulk 52 is seen being emitted out of the caulk outlet orifice. After the spout has progressed towards the viewer here this bead assumes a more triangular cross-sectional shape as the spout tip smooths out the oozing caulk. After one corner has been caulked the other conjoining corner is caulked as shown in FIG. 11 by simply placing the round tip 18 of the spout into the three-way corner and moving off in the other direction. Since the tip is spherical this action does not reshape the previously formed bead.

It thus is seen that a caulking spout is provided of very simple and economical construction and yet one that possesses a unique combination of versatility where operational versatility is desired and operational steadfastness where uniformity is desired of bead configuration. It should however be understood that the particular embodiment just described merely illustrates principles of the invention in one preferred form. Many modifications, additions and deletions may, of course, be made thereto without departure from the spirit and scope of the invention as set forth in the following claims:

I claim:

1. A caulking spout through which caulk may be dispensed from a dispenser into a corner joint at various angles of attack without an accompanying substantial change in the shape of the bead of caulk being dispensed and with the spout comprising a body elongated along a body axis merging with a rounded tip traversing said axis; an outlet orifice formed in said rounded tip to one side of and off said body axis; an inlet orifice formed in the end of said elongated body distal said rounded tip and a channel communicating between said inlet orifice and said outlet orifice with a first channel portion extending from said inlet orifice along said body axis and merging with a second channel portion diverging from said body axis and terminating at said outlet orifice.

2. A caulking spout in accordance with claim 1 wherein said channel first portion is generally conical and tapers inwardly from said inlet orifice towards said rounded tip to receive and snuggly grip a tubular dispenser nozzle positioned therewithin.

3. A caulking spout in accordance with claim 1 wherein said rounded tip is substantially semi-spherical.

4. A caulking spout in accordance with claim 3 wherein the exterior of said body is conical.

5. A caulking spout in accordance with claim 3 wherein said outlet orifice is substantially circular and cantic with respect to said body axis.

6. A caulking spout in accordance with claim 5 wherein said outlet orifice is cantic at an angle between approximately 20° and 30° with respect to said body axis.

7. A caulking spout in accordance with claim 1 further comprising index means for locating said outlet orifice.

8. A caulking spout in accordance with claim 7 wherein said index means comprises a rib formed on the side of said rounded tip opposite said outlet orifice.

9. A caulking spout in accordance with claim 1 wherein said body is plastic.

10. A caulking spout in accordance with claim 9 wherein said rounded tip is composed of a softer plastic than said body.

* * * * *